US006151723A

United States Patent [19]

MacAllister

[11] Patent Number: 6,151,723

[45] Date of Patent: Nov. 28, 2000

[54] TOILET SEAT LIFTER WITH LEVERAGE ADJUSTMENT

[76] Inventor: Victor MacAllister, 439 Park Shadows Ct., Baldwin Park, Calif. 91706

[21] Appl. No.: 09/073,060

[22] Filed: May 6, 1998

[51] Int. Cl.[7] ..... A47K 13/10

[52] U.S. Cl. ..... 4/246.1

[58] Field of Search ..... 4/246.1–246.5

[56] References Cited

U.S. PATENT DOCUMENTS 3,303,517 2/1967 Wood et al. ..... 4/246.4
5,487,192 1/1996 Hodges ..... 4/246.3
5,857,223 1/1999 Ferdinand ..... 4/246.1
5,875,498 3/1999 Joseph ..... 4/246.1 X

*Primary Examiner*—Charles E. Phillips
*Attorney, Agent, or Firm*—Liniak, Berenato, Longacre & White

[57] ABSTRACT

A toilet seat elevator system comprising a base, a horizontal pedal member hinged to the base, and a vertical arm hinged between the end of the pedal member and the seat. Variable-length lever arms adjust the static leverage exerted through the linkage. A non-linear spring in the linkage adjusts the dynamic leverage for smoother operation. The toilet seat elevator system may be foot operated or through a sound recognition device.

15 Claims, 4 Drawing Sheets

TOILET SEAT LIFTER WITH LEVERAGE ADJUSTMENT

BACKGROUND OF THE INVENTION

The present invention relates to devices which lift toilet seats and commode seats by foot action or through mechanical or electronic devices such as a sound recognition device so as to avoid the use of the hands. In particular, the present invention is directed to toilet seat elevator systems that utilize a foot operated pedal, a sound recognition device, or a combination thereof, to raise and lower the toilet seat.

Systems for the hands-free operation of raising a nd lowering of toilet seats are useful for a number of reasons. The majority of men raise the seat of a toilet to urinate from a standing position, and so must lift the seat prior to the majority of uses. Both men and women lift the seat when cleaning the toilet bowl. Many people consider a toilet seat to be slightly disgusting or a vector for disease, and so dislike touching a toilet seat with their hands. Some people use their feet to move the seat, which is awkward and tends to dirty the seat. Thus, a toilet seat lifter or elevator system that allows hands-free operation is not only a convenience, but also permits a more sanitary operation.

In the majority of toilets, the toilet bowl has bolt holes at the rear that are used for attaching the bowl portion with the seat, which the user sits on, and the seat cover or lid, which closes the bowl by covering the opening in the seat. The cover and the seat are independently hinged, usually on the same hinge axis. In most toilets, when the seat is fully lifted, the center of gravity of the seat moves past the vertical, balanced position directly over the hinge axis to a position to the rear of the hinge axis. This means that the seat, when fully lifted and rotated backward, leans against the toilet water chest or the wall behind the bowl, and is stable. To lower the seat after urination or cleaning, the hands must be used again to pull the seat past the vertical balanced position to a forward-leaning position in which gravity can pull the seat down to the closed position.

Many men fail to lower the seat after raising it to urinate. Women are often upset by this common failure of men; women seldom raise the seat themselves and so tend to assume that the seat will be in the lowered position when they go to use the toilet. Women are thus likely to sit on the toilet without checking to see if the seat is down, and therefore are likely to sit directly onto the toilet bowl if the seat has been left in the lifted position, risking injury. Therefore, it is desirable for a mechanism that lifts the seat to also lower it automatically.

Yoke et al., in U.S. Pat. No. 5,153,946, disclose an invention which automatically lowers the seat some time after it has been lifted. The device is incorporated into the hinge of the seat and contains a timer, activated by the raising of the seat, that rotates the seat past the vertical point so that gravity can carry it back to the closed position. This invention, however, does not disclose a hands-free method of lifting the seat.

In contrast to the Yoke patent, the seat-raising mechanism in the present invention is so designed that men who wish to urinate standing up can lift the seat by stepping on a foot pedal next to the toilet and urinate while standing on the pedal. When they are finished urinating and release the pedal, the seat should automatically fall back down.

The simplest way of lowering the seat automatically after use is to use gravity. If a seat-raising mechanism does not rotate the seat past the vertical balanced position when it lifts the seat, then the seat will return to the closed position under gravitys force if the mechanism allows it. The design should allow the seat to be rotated past the balance point to a rearwardly-inclined angle, since the seat should remain open by itself for cleaning of the bowl, emptying buckets into the bowl, and so on.

Foot-operated seat lifters which can hold the seat in an inclined position for automatic closure by gravity have been used by several inventors. For example, Daniel Robbins, in U.S. Pat. No. 5,075,906, teaches a foot-operated seat lifter which holds the seat to a forwardly-inclined position. The mechanism consists of a base resting on the floor beside the toilet, a pedal hinged to the base, and a linkage of three members connecting the pedal to the seat. A total of six hinges is used for the pedal and linkage. Besides the complexity of five moving parts and six hinges, another drawback is that the Robbins device has no adjustments to allow its use with toilets of differing design. Moreover, it appears in his FIG. 1 that the base of the device is likely to move when the seat is fully opened to a rearward position for cleaning. When the pedal of the Robbins device is fully depressed, the seat is in the forwardly-inclined position as shown in FIG. 1; if the seat were moved to the rearwardly-inclined position, then the base would be lifted off the floor and moved to the left in the drawing figure. This is due to the fact that the linkage connecting the base to the seat is angled. If the base hinge were more directly under the seat hinge, then the base would be less likely to move.

U.S. Pat. No. 4,649,576, issued to David Lillie, discloses a seat lifter which is simpler than the complex device of Robbins. Instead of an immoveable base, Lillie uses a rocker block which combines the base and pedal into one block of wood or plastic. The user steps on one end of the block, which rocks backward under the force. The other end of the block moves upward. A vertical arm is attached to that end, so that stepping on the block lifts the arm. The upper end of the arm is connected to the seat. Lillie's vertical arm is adjustable in length (see FIG. 2). An eye bolt 212 screws in and out of the vertical arm 104 to vary the length. Since the eye bolt is also free to rotate in the vertical arm 104, and can also rotate substantially to and fro due to its loose fit on the flanged end 222, the rocker block 100 at the lower end of the arm is likely to rotate out of its proper position (as well as sliding out of its proper position on the floor, like the base of Robbins' device). Indeed, Lillie advises that a strap 324 on the block be nailed or glued to the floor to hold the rocker block 100 in position. The Lillie device has only one adjustment, the length of the arm.

Pilkington et al., in U.S. Pat. No. 4,030,146, describe a seat lifter with a base, a pedal, and an upright arm joining the pedal to the seat. Like the Robbins invention, the Pilkington device has no adjustments whatsoever. Accordingly, the device will not function with various toilet heights. Even a small variation in floor height will cause a variation of the angle of the raised seat when, as shown in their FIG. 1, the end 60 of the pedal 16 is fully depressed to the floor. Moreover, a tilt of the floor can cause the whole Pilkington device to be thrown askew, and possibly to jam as undue torque is put on the hinges of the device.

L. D. Svedelius, in U.S. Pat. No. 1,999,070, also shows a seat lifter which can maintain the seat in a forwardly-inclined position. It is not adjustable.

None of the patents listed above has any provision for varying the force required on the pedal to lift the seat. That is, none has any means for varying the ratio between the foot force applied to the foot end of the pedal member and-the seat-raising force applied by the upper end of the arm to the toilet seat. Thus, these inventions will not work equally well with toilet seats of various weights. Toilet seats are made of everything from solid oak to vinyl-covered urethane foam and they vary widely in weight. The functioning of these inventions will vary accordingly.

Several of the above devices, and other previous inventions, include a mechanism for cushioning the shock of a toilet seat which falls down onto the toilet bowl. For example, the Lillie invention uses a bellows to cushion the fall with compressed air; Pilkington et al. employ a U-shaped spring to prevent slamming. However, such complications are not needed. Toilet seats are designed to be dropped in normal use, and seldom break despite the rough usage they receive.

While energy absorption is not needed in a seat lifter of the type described above, resilience is. The reason is that, when a user steps onto the pedal of the device, the initial force must be greater than the force applied a short time later, for two reasons. First, the mechanical advantage is least when the seat is horizontal and the center of gravity of the seat is farthest from the seat hinge; second, the inertia of the seat must be overcome and extra force is needed at the beginning of the upward motion of the seat.

If the entire mechanism is rigid, like those discussed above, then the user who steps onto the pedal may sense from the high resistance of the pedal that a large force is needed. He may then push too hard, causing the seat to fly past the desired point and crash into the wall or water chest.

If a portion of the mechanism is resilient, then any excess force will compress the resilient member. The user, sensing a softer pedal, will tread less hard. The energy stored in the resilient member will be recovered as the seat swings up. Resilience in the mechanism is thus a means for varying the mechanism's dynamic leverage, that is, the instantaneous ratio between the force applied to the foot end of the pedal member and the force applied by the upper end of the arm to the toilet seat, while the seat is accelerating. The act of raising the seat by stepping on the pedal creates a dynamic situation, in which the acceleration of the seat affects the forces. It is to be contrasted with the static leverage that applies when the seat is held in at a fixed angle by foot pressure. A resilient member in the linkage will not vary the static leverage, but it will vary the dynamic leverage.

Pilkington et al., as mentioned above, include a resilient U-shaped member 14 or 50 in their device to cushion the shock of the falling toilet seat. This U-shaped member is not part of either the pedal or the arm, but is rather connected in between them. Being resilient, it is not an energy absorber or damper. It apparently serves to pre-load the mechanism toward a seat-raised position. Pilkington et al. state at column 3, line 58: "[T]he member 50 . . . due to its resilient characteristics it serves as the bowed member 14 . . . which serves to bias the rear portion of the pedal 16 in an upward direction." At column 4, line 5, they continue: "When the foot is removed, the seat 22 falls . . . however, due to . . . force exerted by the bowed member 14, the seat is prevented from slamming." The member 14 or 50 is stressed in the seat-down position, exerting an upward force on the rear end of the pedal, and reducing the force needed to begin pushing the pedal down.

S. Kuno, in U.S. Pat. No. 1,505,472, shows a seat lifter which employs a curved arm and coil springs 19 and 20 mounted between the pedal and the arm. The springs, acting with a third rigid member between the pedal and arm, force the seat toward an intermediate position. While Kuno does not explain the mechanism, the provision of the springs and the slot in the curved arm in which a pin of the third member rides, imply that the curvature of the arm is not related to any resilient quality of the arm. Kuno shows a simple mechanism with coil springs in U.S. Pat. No. 1,509,242.

U.S. Pat. No. 4,862,525 to Cheng shows a lifter with a coil spring in the base which exerts a lifting force in the initial portion of the lift, and then exerts no force.

U.S. Pat. No. 1,501,177, issued to B. Ozwirk, shows a telescopic friction damper between the pedal and the arm.

The springs disclosed in these patents are ill-suited to adjusting the dynamic leverage. One reason is that they obey Hooke's Law. Hooke's Law is said to be obeyed when a spring's deflection is directly proportional to the force that causes it to deflect. Coil springs are well-known for obeying Hooke's principle, and the U-shaped spring of Pilkington et al. also approximates it well, Hooke's Law is disobeyed by many resilient objects. A slightly bowed rod or plate, for example, is quite stiff when it is straight; as it begins to bend, its increasing curvature makes it less stiff. The ratio of force to deflection is not constant. Simple experiments with a 3 by 5 card or a bendable ruler will verify this.

Springs which are stressed in the seat-closed position exert a force on the pedal that reduces the force to be exerted by the users foot but does not affect the dynamic leverage of the mechanism. Reduction in static force is not needed because a person, who outweighs a toilet seat by at least ten to one, can easily exert more than enough force on the pedal to lift the seat; the user's problem is control of the stepping force. Force must be applied smoothly to avoid over-accelerating the seat and banging it back against the wall or water chest.

The prior art is not seen to disclose any seat lifter of the pedal and arm type which incorporates dynamic or static leverage adjustment.

SUMMARY OF THE INVENTION

Accordingly, the present invention contemplates a toilet seat lifter having: a support member such as a base resting on the floor near the toilet; a generally horizontal pedal member hinged at a midpoint to the base, to be stepped on by the user's foot at one end, designated the foot end of the pedal; a generally vertical arm hinged at its lower end to the end of the pedal opposite to the foot end; and a hinge connection between the upper end of the arm and the seat, at a point some distance away from the hinge on which the seat rotates relative to the toilet.

The three hinges of the invention may have their axes all generally parallel to one another, so that the linkage from the foot end of the pedal to the seat is not thrown askew. The axes are also parallel to the floor. The hinge axes are generally transverse to the front-back direction of the toilet.

The toilet seat elevator system, of the present invention constitutes a linkage, transmitting a force exerted by the user on the foot end of the pedal into a seat-rotating force that lifts the seat and/or the seat cover to the opened position. The ratio of these forces is called the leverage. The invention includes two kinds of adjustment to the leverage of the linkage, which enable the invention to be used more easily than previous inventions.

To vary the dynamic leverage (that is, the instantaneous leverage which combines the static leverage with the reaction forces of the accelerating seat) the invention provides a bowed arm which responds non-linearly to longitudinal compression forces.

To vary the static leverage, the present invention provides an adjustment of the distance between the joints or hinges near the floor. Preferably, the adjustment varies the distance between the pedal-base hinge and the arm-pedal hinge while keeping fixed the distance between the pedal-base hinge and the foot end of the pedal. Alternatively, the base-pedal hinge may be moved along the pedal between the arm-pedal hinge and the foot end.

The invention also includes adjustments that allow the invention to be used with toilets of various heights and sizes, including regular or elongated type bowls, or other designs. When the foot end of the pedal is depressed fully to the floor, the linkage should be such that the seat is inclined slightly forward of the vertical, balanced position.

The invention can be used on either the left or the right side of the toilet.

DESCRIPTION OF THE DRAWING FIGURES

For a further understanding of the nature and objects of the present invention reference should be had to the following description, taken in conjunction with the accompanying drawings in which like parts are given to like reference numerals and wherein:

FIG. 1. is a perspective, partially exploded, view of the toilet seat elevator system of the present invention attached to a toilet, FIG. 2 is a perspective view of another embodiment of the present invention in which a support member is attached to the toilet C;

FIG. 3 is a perspective view of yet another embodiment of the present invention in which a housing integral with the toilet contains the toilet seat elevator system; and FIG. 4 is a perspective view of yet another embodiment of the present invention in which a housing integral with the toilet contains the toilet seat elevator system that is activated by a sound recognition device with a built-in timing device or timer.

DETAILED DESCRIPTION OF THE INVENTION

In the following specification and claims: the term "front" means the direction in which a person faces when sitting on the toilet in the usual posture; "rear" means the opposite direction, toward the end of the toilet where the seat hinges, water chest, or wall are generally located; "forwardly inclined" means leaning toward the front; "rearwardly inclined" means leaning toward the rear; "height" refers to elevation from a floor upward; "toilet height" means the distance between the floor and the underside of the toilet seat when it rests in the closed position against the toilet; "seat" means either the seat proper, or the seat with the seat cover resting against it; and "moment-arm" means a distance between one hinge joint and another.

Figure 1:
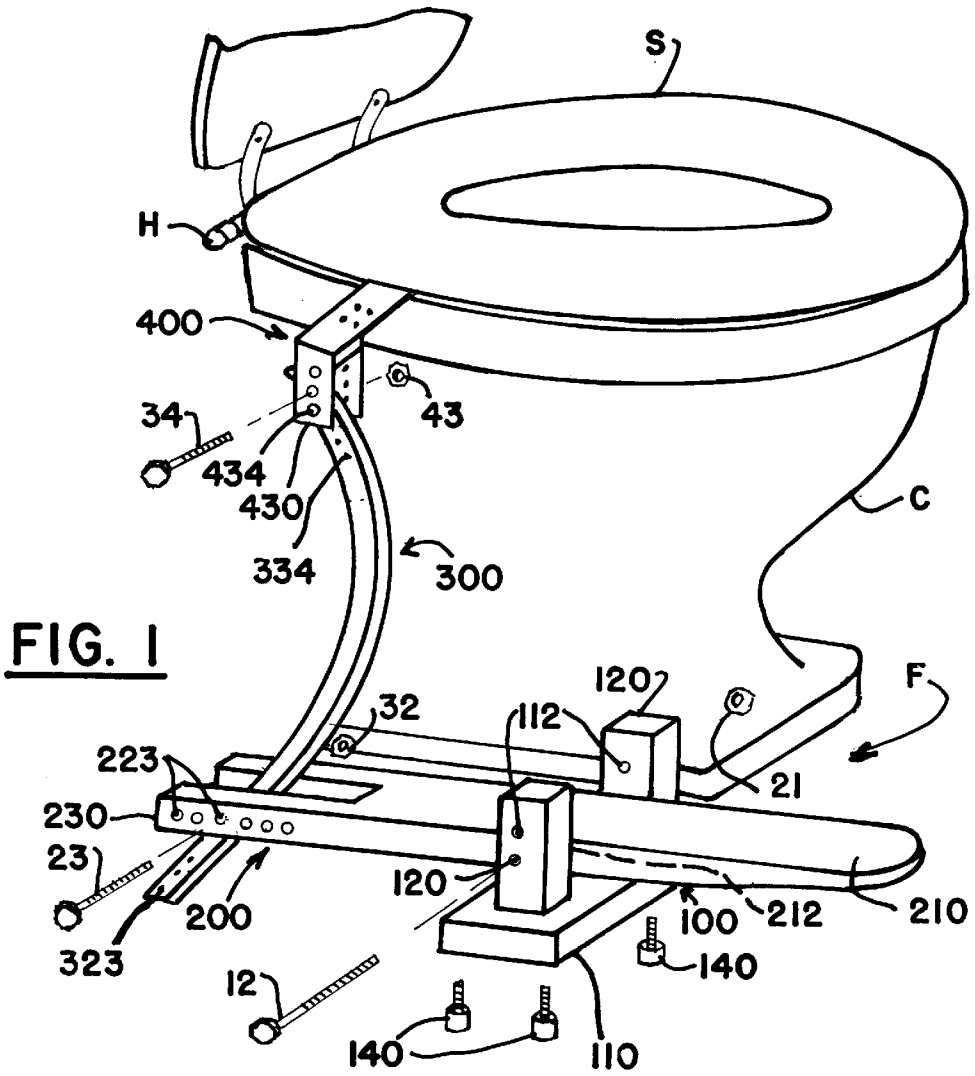

The invention, a toilet seat lifter, is shown in FIG. 1. FIG. 1 also shows a toilet C, a toilet seat S, and a hinge H connecting the toilet C and the seat S. The toilet C rests on a floor F.

The invention includes four main parts which are hingedly interconnected so as to move relative to one another: a base 100, a pedal 200, a bowed arm 300, and a bracket 400.

A toilet user, who wishes to raise the seat S for standing urination (or some other purpose), but does not wish to touch the seat S with his hands, steps upon the foot end 210 of the pedal 200. As the base 100 rests firmly on the floor F, the pedal 200 rotates under his weight in a clockwise direction as seen in FIG. 1. This raises the arm 300, which in turn lifts the seat S, to which the bracket 400 is screwed. When the foot end 210 is pushed all the way down against the floor F, the seat S should be in a forwardly-inclined position, raised high enough that the user can urinate directly into the bowl of the toilet C without hitting the seat S. And then, when foot pressure is released, the seat S will fall back to the closed position. This description illustrates a properly installed unit. However, if the seat S is raised too high, it will balance and will not fall back. If the mechanism allows the seat S to rotate past the vertical, balanced position the user can cause the seat S to gain enough momentum to swing into a rearwardly-leaning position against the wall or the water chest (not shown). The invention may optionally prevent this by design of the linkage. This describes a unit that is not properly installed or adjusted. Corrections or adjustments should then be made for it to function properly.

Bolts 12, 23, and 34 are shown exploded out of respective ones of the sets of holes 112, 223 and 434. These bolts 12, 23 and 34 act as hinge pins for the joints which connect the base 100, pedal 200, arm 300, and bracket 400. They should fit into the holes without a great deal of play, but should not fit so snugly that they cannot rotate within the holes.

Holes 112, 223 and 434 are preferably through-holes bored or otherwise formed through the base uprights 120, pedal rear forks 230, and bracket forks 430, respectively.

Bolt 12, when inserted fully into the hole 112, also passes through a hole 212 in the pedal 200 and another one of the holes 112 in the other base upright 120. It is kept in position by a nut 21 screwed onto the bolt 12 end, which protrudes when the bolt 12 is fully inserted.

Bolt 23, when inserted fully into the hole 223, passes as well through a hole 323 through the arm 300 and another one of the holes 223 in the other pedal fork 230. It is kept in position by a nut 32.

Bolt 34, when inserted fully into the hole 434, passes through a hole 334 in the arm 300 and another one of the holes 434 in the other bracket fork 430. It is kept in position by a nut 43.

If needed to increase the angle through which the seat S can rotate, the forks 430 may be lengthened, horizontally angled, or hingedly attached to the bracket 400. Alternatively, the forks 430 may be eliminated and the bolt 34 (or an equivalent rod member) passed through the arm 300 directly into the bracket 400. Other conventional alternative connections between the arm 300 and the seat S, which do not restrict the rotation, are also possible.

For cleaning purposes, this design may also allow the user to manually lift the seat S, rotating past the vertical position into a rearwardly-leaning position to rest stably against the wall or water closet.

Nuts 21, 32 and 43 may be secured onto the bolts 12, 23 and 34 by various means, such as lock washers, anaerobic adhesives, nylon inserts in the nuts, or any other conventional means. The invention can also use pins, quick-release clips, rods and the like instead of bolts and nuts. The joints may be formed by hinges fastened to the members without the use of through holes, flexible straps, and so on.

Each of the pluralities of holes 112, 223, 323, 334 and 434 allows an adjustment when a corresponding one of the bolts 12, 23, and 34 are selectively inserted into one of the holes. Pluralities of holes 212 through the middle of the pedal 200 allow the leverage of the foot end 210 relative to the arm 300 to be further adjusted.

Selecting among the holes 112 controls the height of the middle of the pedal 200. This height, in conjunction with the other settings, changes the distance between the underside of the foot end 210 and the floor F. That distance, multiplied by the mechanical advantage of the overall linkage of the invention, should be equal to the distance the bracket 400 must move to lift the seat S into a raised, forwardly-inclined position. The tilt of the pedal 200 is also affected by the selection of one of the holes 112.

Selection of one of the holes 223 affects two parameters of the invention: the inclination of the seat S when the pedal 200 is pressed to the floor F; and the force needed to lift the seat S.

Holes 323 and holes 334 in the arm 300 both affect the effective length of the arm 300 as a link. These can be selected for adapting the invention to toilets of varying height (that is, vertical distance from the floor F to the seat S) and size (regular or elongated bowl) and also for changing the tilt of the pedal 200. Selection of holes 434 adjusts for height. A final adjustment is provided by a screw-in feet 140, shown exploded out of the bottom of the plate 110 of the base 100. (As pictured, the feet 140 are located underneath plate 110.) The feet 140 are screwed in and out to level the invention on floors which may be tilted. Such tilting is common near toilets due to imperfect construction work and/or leakage. The feet 140 may include friction pads for contact with hard floors, spikes for carpet, etc.

The present invention allows the static leverage (i.e, the mechanical advantage of the linkage) to be varied by selecting different pedal holes 223. Even with a heavy solid-oak seat S, the user can still operate this invention with minimal force when he steps on the foot pedal end 210, if the proper holes have been selected as pivots.

The arm 300 is made of resilient material and is formed in a bowed shape. It acts as a compression spring between the pedal 200 and bracket 400. When force is transmitted to the arm 300 by the bolts 23 and 34, the ability of the arm 300 to rotate about those bolts prevents them from exerting any bending force on the arm 300. Thus, the forces on the arm 300 are purely compressional, acting along a line between the bolts 23 and 34.

Due to the bowed shape of the arm 300, such an applied force tends to bend the arm 300 into a more deeply bowed shape. As the amount of bow increases, so does the bending force along the arm. As a result the "spring constant" of the arm 300 changes with increased bowing due to increased force. This means that, for the arm 300, the spring constant is not constant. Mother way of saying this is that the arm 300 is a non-linear spring which does not obey Hooke's Law.

Either a linear spring or a non-linear spring in the linkage of the invention would affect the dynamic leverage, that is, the instantaneous ratio of input force (by the user's foot) to output force (exerted by the bracket 400 on the seat S). This is because extra force is needed when the seat S first begins to lift, to overcome its inertia. But a non-linear spring, which requires more force to begin compressing, is ideally suited to this application because the user will exert a relatively large force on first contact with the foot end 210. A larger spring constant is needed at this initial contact; once the arm 300 is in motion, a lesser spring constant is better. Moreover, the spring constant should vary smoothly over the compression range of the spring.

Figure 2:
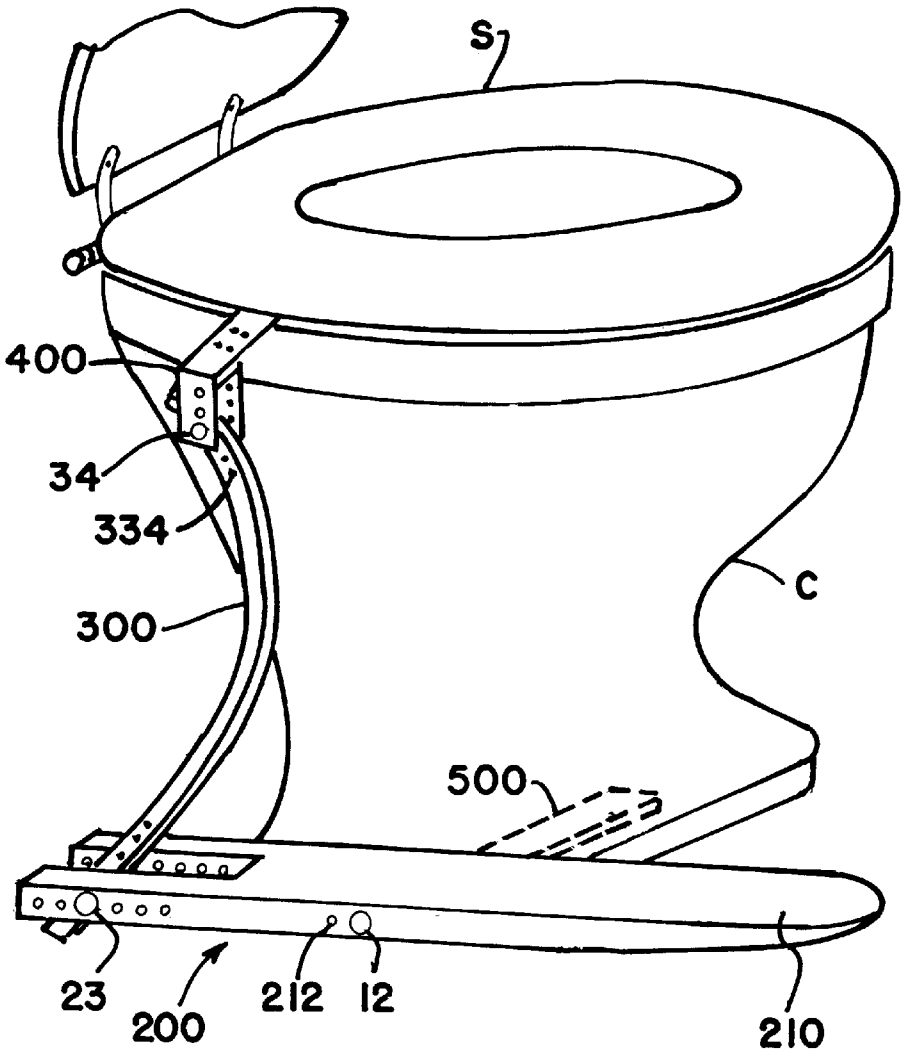

An alternative embodiment of the invention is shown in FIG. 2: The base 100 may be replaced with a member 500 attached to the toilet C to form a single built-in unit. The member 500, like the base 100, is a support for the pedal 200. (The attachment of the rod 500, and the rod itself, are merely exemplary. Any sort of support member connecting the toilet C to the pedal 200 and allowing relative rotation therebetween is contemplated, whether unitary with the toilet or add-on.) The bolts 12, 23, 34 are shown inserted, rather than exploded, in FIG. 2.

The invention may be made of any suitable materials. For ease of production and cleaning, plastic is preferred. The material should not be fragile. The bowed arm 300 and the bracket 400 should be stiff yet flexible enough to absorb shocks without cracking or breaking. Wood may be used for the base 100 and pedal 200 and metal for the arm 300 and bracket 400, if desired.

Bracket 400 can be attached to the seat S by screws, bolts, adhesive, or any other means whether permanent or demountable. In an alternative embodiment, the bracket 400 may also be integrally molded or otherwise formed as part of the seat S.

The bracket 400 may be made as a mirror image of that depicted in FIG. 1, and the invention may be used or installed on either side of the toilet, left or right.

With the present invention a user may train himself to gently lower the seat S, so as to avoid banging, by keeping foot pressure on the foot end 210 of the pedal 200.

The scope of the invention also includes any sort of hinge-like connection between the arm 300 and the seat S, whether or not a bracket, protrusion, or the like is disposed between the arm 300 and seat S. For example, the arm 300 could have a ball end snap fitted into a socket on the underside of the seat S; the bolt 34 could be inserted through the arm hole 334 and thence into a threaded hole in the side of the seat S adapted to accept the bolt 34; and so on. Any flexible connection can be used.

Figure 3:
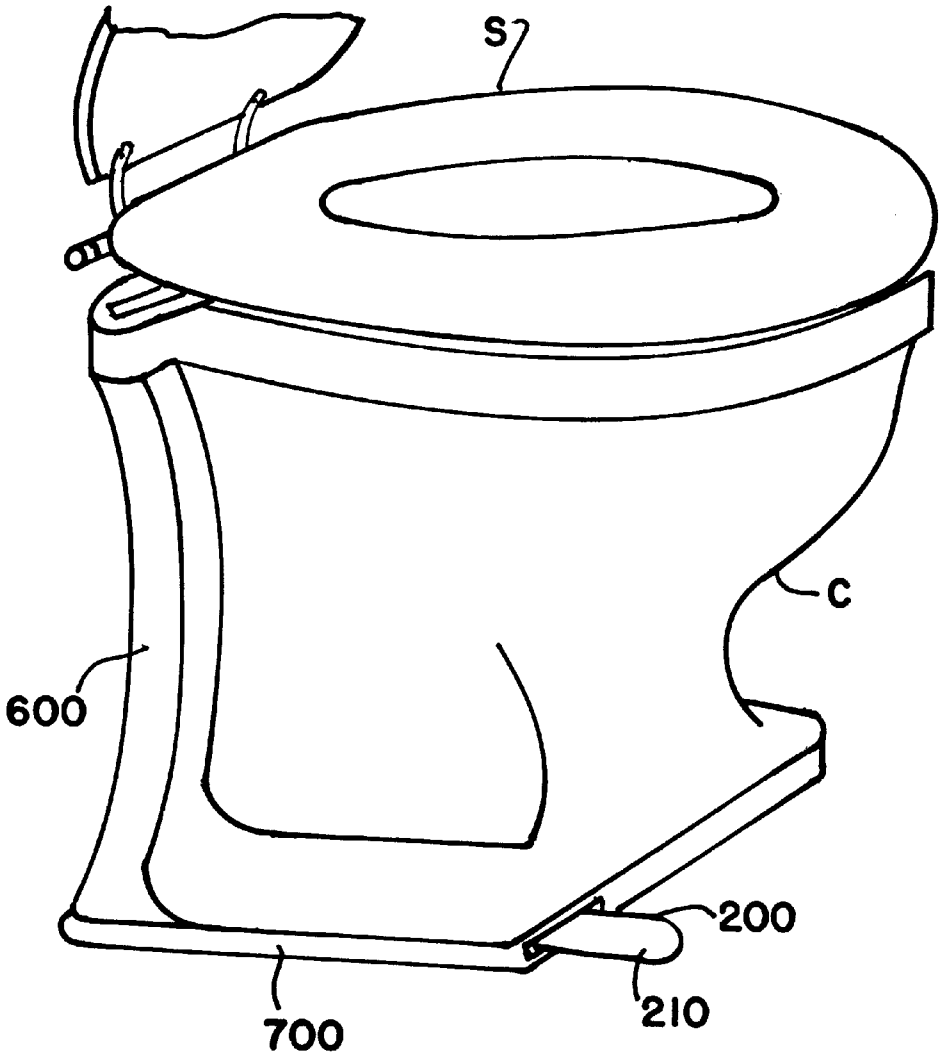

As shown in FIG. 3, the toilet seat elevator system of the present invention may be contained in a housing unit integral with the toilet to provide a pleasing appearance. For example, the pedal 200 is contained within the pedal housing portion 700 and the arm 300 is contained within the arm housing portion 600. These housing portions 600 and 700 may be of a unitary construction with the toilet or they may be made of the same or a complementary material that is molded or conformed to closely follow the lines of the toilet.

Figure 4:
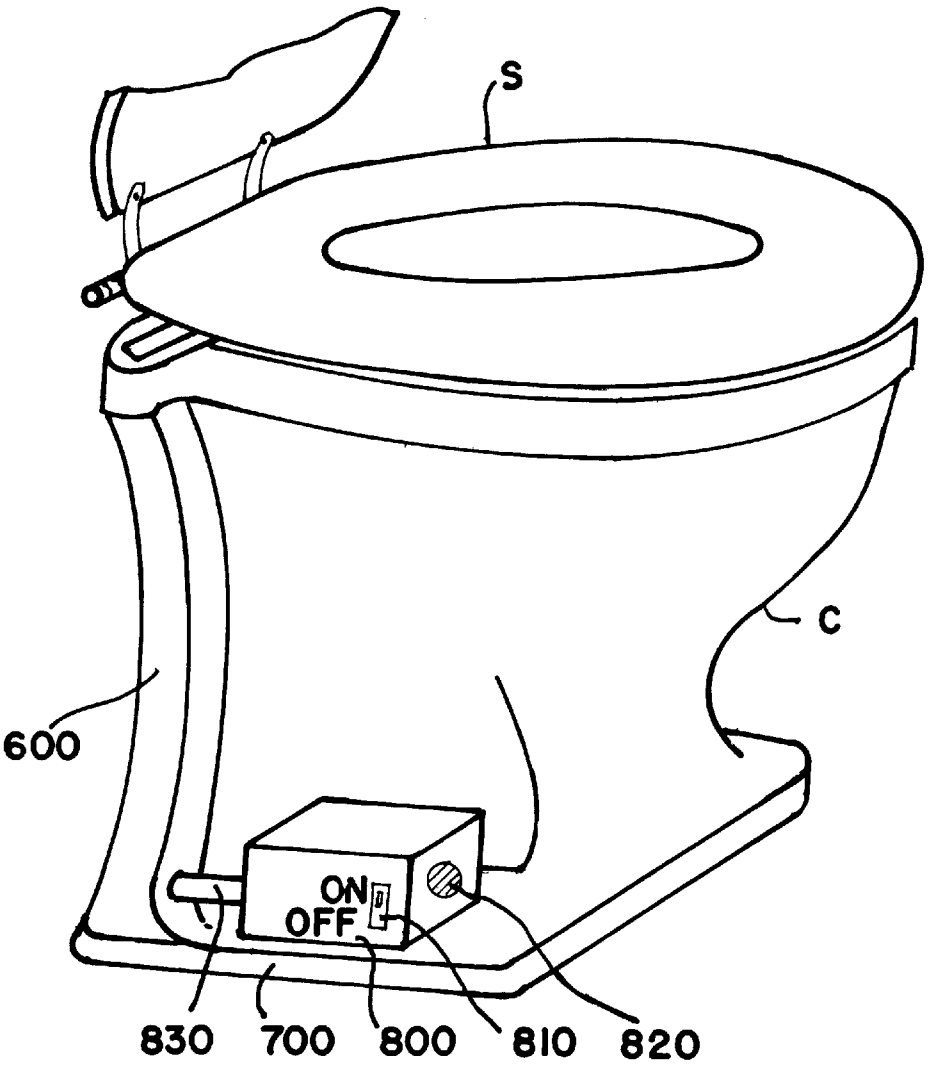

As shown in FIG. 4, the toilet seat elevator system of the present invention may be contained in a housing unit integral with a toilet 700 that is activated by a sound recognition device as well as a timing device 800. Automatic timer is built in the sound recognition device ("SRD") 800.

The sound recognition device 800 sends signals to the arm housing Portion 600 via a connector 830. It may also send its signal via an infared signal device. The sound recognition device 800 may be powered by batteries or AC current. The sound recognition device may also contain an On/Off switch 810, and a sound receptor 820.

The sound recognition device operates through voice command or clapping of hands, which causes the sound receptor 820 to transmit a signal to arm housing portion 600 causing the toilet seat S to be automatically lifted up at a proper angle. After an elapsed period of a predetermined time, i.e. four minutes after the toilet seat S was lifted up, the timing device 800 sends a signal to the arm housing portion 600 to close down the toilet seat S.

The present invention may be equipped with some form of lighting elements, i.e. self-lit phosphorous which glows in the dark or any suitable night light devices or materials.

The present invention may also be equipped with any suitable shock absorbing devices to dampen the noise when pedal 200 is released prematurely.

The particular embodiments described above are the best mode of the invention contemplated. The invention is not limited by the particular embodiments described above, but includes all embodiments within the scope of the following claims.

What is claimed is:

1. A toilet seat elevator system for use with a toilet having a seat rotatably joined to the toilet for raising and lowering the seat on the toilet, said seat elevator system comprising:

a support member;

a pedal member having a foot end and a hinge end;

an arm having a lower end and an upper end;

a pedal joint hingedly connecting the support member to the pedal member;

an arm joint hingedly connecting the hinge end of the pedal member to the lower end of the arm;

a seat joint hingedly connecting the upper end of the arm to the seat; and leverage adjustments means for varying a ratio between a foot force applied to the foot end of the pedal member and a seat-raising force applied by the upper end of the arm to the seat, wherein the leverage adjustment means includes means for making the arm resilient under compression force between the lower end and the upper end.

2. The toilet seat elevator system of claim 1, wherein the leverage adjustment means includes a bowed variable moment-arm length.

3. The toilet seat elevator system of claim 2, wherein the leverage adjustment means includes a variable lever arm length between the pedal joint and the arm joint.

4. The toilet elevator system of claim 1, including an angle adjustment such that, when the foot end of the pedal is pressed against a floor adjacent the toilet, the seat may be inclined at a forward angle.

5. The toilet seat elevator system of claim 1, wherein the arm is a non-linear spring.

6. The toilet seat elevator system of claim 1, wherein the arm is bowed.

7. The toilet elevator system of claim 1, wherein the support member further comprises a base for resting on a floor adjacent the toilet.

8. The toilet seat elevator system of claim 7, wherein the base includes adjustable feet for angular alignment of the seat lifter to the floor.

9. The toilet elevator system of claim 1, including a height adjustment such that the lifter may be used with toilets of various toilet heights.

10. The toilet elevator system of claim 1, including a length adjustment such that the lifter may be used selectively with toilets having regular and elongated bowls.

11. The toilet seat elevator system of claim 1, wherein the seat includes a bracket fixed to the seat and hingedly connected to the upper end of the arm.

12. The toilet seat elevator system of claim 11, wherein the bracket is integral with the seat.

13. A toilet seat elevator system for use with a toilet having a seat rotatably joined to the toilet for raising and lowering the seat on the toilet, said seat elevator system comprising:

a support member;

a pedal member having a foot end and a hinge end;

an arm having a lower end and an upper end;

a pedal joint hingedly connecting the support member to the pedal member;

an arm joint hingedly connecting the hinge end of the pedal member to the lower end of the arm;

a seat joint hingedly connecting the upper end of the arm to the seat; and leverage adjustments means for varying a ratio between a foot force applied to the foot end of the pedal member and a seat-raising force applied by the upper end of the arm to the seat, wherein the leverage adjustment means includes a variable moment-arm length and means for making the arm resilient under compression force between the lower end and the upper end.

14. The toilet elevator system of claim 13, wherein the arm is a non-linear spring.

15. The toilet elevator system of claim 14, wherein the arm is bowed.

* * * * *